United States Patent [19]

Gannon et al.

[11] Patent Number: 4,593,460

[45] Date of Patent: Jun. 10, 1986

[54] METHOD TO ACHIEVE A DESIRED BANDWIDTH AT A GIVEN FREQUENCY IN A DIELECTRIC RESONATOR FILTER

[75] Inventors: Mark A. Gannon, Schaumburg; Francis R. Yester, Jr., Arlington Heights, both of Ill.

[73] Assignee: Motorola, Inc., Schaumburg, Ill.

[21] Appl. No.: 567,438

[22] Filed: Dec. 30, 1983

[51] Int. Cl.[4] ..... H01P 1/20; H01F 41/00

[52] U.S. Cl. ..... 29/602 R; 29/600; 333/199; 333/208

[58] Field of Search ..... 29/602 R, 606, 600; 333/197–199, 208–212

[56] References Cited

U.S. PATENT DOCUMENTS

| | | | |
|---|---|---|---|
| 3,187,277 | 1/1965 | Wantuch . | |
| 3,212,034 | 10/1965 | Kaufman et al. . | |
| 3,443,131 | 5/1969 | Oltman, Jr. | 310/8.1 |
| 3,475,642 | 10/1969 | Karp et al. . | |
| 3,818,388 | 6/1974 | Hill et al. . | |
| 3,840,828 | 10/1974 | Linn et al. . | |
| 3,973,226 | 8/1976 | Affolter et al. . | |
| 4,061,992 | 12/1977 | Inokuchi . | |
| 4,142,164 | 2/1979 | Nishikawa et al. . | |
| 4,143,344 | 3/1979 | Nishikawa et al. . | |
| 4,179,673 | 12/1979 | Nishikawa et al. . | |
| 4,268,809 | 5/1981 | Makimoto et al. . | |
| 4,283,687 | 8/1981 | Masuda et al. . | |
| 4,477,785 | 10/1984 | Atia | 333/202 |

OTHER PUBLICATIONS

Plourde & Chung-Li Ren, "Application of Dielectric Resonators in Microwave Components", IEEE Transactions on Microwave Theory & Techniques, vol. MTT-29, No. 8, Aug. 1981.

Cohn, "Microwave Bandpass Filters Containing High-Q Dielectric Resonators", IEEE Transactions on Microwave Theory and Techniques, vol. MTT-16, No. 4, Apr. 1968.

*Primary Examiner*—Carl E. Hall

*Attorney, Agent, or Firm*—F. John Motsinger; Edward M. Roney; James W. Gillman

[57] ABSTRACT

There is provided a method and a corresponding apparatus for establishing the proper bandwidth at one frequency in a microwave, dielectric resonator waveguide filter.

Bandwidth is determined by the product of the resonant center frequency and the interresonator coupling coefficient. The interresonator coupling coefficient has been found to vary depending upon the interresonator spacing as well as the position at which the resonators intercept the electromagnetic field distributed across the waveguide.

This method establishes the proper combination of field-intercepting position and interresonator spacing such that the proper bandwidth is established at one frequency.

18 Claims, 3 Drawing Figures

METHOD TO ACHIEVE A DESIRED BANDWIDTH AT A GIVEN FREQUENCY IN A DIELECTRIC RESONATOR FILTER

CROSS REFERENCE TO RELATED APPLICATIONS

Filing Date: Dec. 30, 1983
Ser. No. 567,437

A method for maintaining constant bandwidth over a frequency spectrum in a dielectric resonator filter.

A dielectric resonator filter to achieve a desired bandwidth characteristic.

THE FIELD OF INVENTION

The disclosed invention, herein, is concerned with filter design.

More particularly, this invention relates to ways of controlling filter bandwidth in coupled dielectric resonator filters.

Specifically, this disclosure illustrates methods and an apparatus for controlling microwave filter bandwidth characteristics by altering the spatial location between resonators and their location with respect to an electromagnetic field.

BACKGROUND OF THE INVENTION

With increasing spectral crowding at lower frequencies, microwave communications have become a viable alternative and present some interesting opportunities. However, microwave communications have their own set of particularized problems that need to be resolved before extensive commercialization of microwave communications can be realized.

Microwave filter design is but one of those problems to be resolved.

More particularly, in microwave communications, where the microwave frequency spectrum must be heavily subdivided, microwave filter design has become particularly troublesome.

Microwave waveguide dielectric resonator filters have been employed to perform bandpass and band reject functions. Ordinarily, a waveguide of rectangular cross section is provided with a dielectric resonator that resonates at a single center frequency as it is excited by the microwave electromagnetic field. The center frequency of the filter can be set in various ways. The center frequency can be changed by introducing a disturbance in the electromagnetic field about the dielectric resonator or by altering the mass of the resonator.

The response characteristic of the filter can be altered by introducing a number of dielectric resonators in proximity with each other such that the radiated energy coupled from one resonator to the next alters the bandwidth of the filter. It is well known that the bandwidth of a filter is a function of the product of the resonant frequency of the filter and the interresonator coupling coefficient-a coefficient of the energy coupled between resonators. In dielectric resonator filters, the interresonator coupling coefficient can be changed in a variety of ways.

In an evanescent mode waveguide (a waveguide below cut off), dielectric resonators are usually cascaded at the cross sectional center line in a rectangular waveguide (i.e. at the electromagnetic field maxima). To achieve a certain, desired bandwidth, the resonators are longitudinally spaced to provide the desired interresonator coupling. Since the bandwidth is a function of both interresonator coupling and center frequency, a different spacing between resonators (interresonator spacing) is required for each center frequency to maintain the desired filter bandwidth. Accordingly, the cumulative filter length is different for each and every center frequency. Therefore, heavy subdivision of a frequency spectrum results in a multiplicity of filter lengths, corresponding component parts, and manufacturing fixtures.

To eliminate the multiplicity of filter lengths required to service any frequency spectrum, tuning devices were injected to disrupt the energy coupled between resonators (interresonator coupling), thereby providing a tunable bandwidth. However, tuning could only be performed over a relatively small range of frequencies. Also, in multiple pole filters, tuning became an extremely sensitive and laborious task due to the large number of bidirectional and cumulative interresonator couplings and the interaction with the multiple tuning devices.

The invention presented herein solves the tuning problem by fixing the interresonator spacing and altering the interresonator coupling coefficient by simultaneously adjusting the position at which the resonators intercept the electromagnetic field distributed across the waveguide cross section.

This invention represents a significant advance over the prior art and over this technical field by providing a single filter structure that can be utilized without resorting to extensive tuning.

BRIEF SUMMARY OF THE INVENTION

It is the object of the present invention to provide a simple dielectric resonator filter structure that may be easily set to the proper resonant frequency and a method for simply arriving at the desired bandwidth.

The instant invention provides a way of arriving at the desired bandwidth once the interresonator spacing has been established.

The ultimate object of the present invention is to provide a single structure that requires little or no tuning of the bandwidth such that the structure need only be set to the proper resonant frequency and properly placed with respect to the electromagnetic field and also provides a method to design such a structure.

In accordance with another of the present inventions there is provided a method and a corresponding apparatus for establishing the proper bandwidth at one frequency in a microwave, dielectric resonator waveguide filter.

Bandwidth is determined by the product of the resonant center frequency and the interresonator coupling coefficient. The interresonator coupling coefficient has been found to vary depending upon the interresonator spacing as well as the position at which the resonators intercept the electromagnetic field distributed across the waveguide.

This invention establishes the proper combination of field-intercepting position and interresonator spacing such that the proper bandwidth is established at one frequency.

Using the aforementioned filter design method results in a final filter structure that meets the objects of the invention. The structure consists of a waveguide having a substrate with dielectric resonators thereon for simultaneously positioning the resonators with respect to the electromagnetic field.

BRIEF DESCRIPTION OF THE DRAWINGS

Additional objects, features, and advantages in accordance with the present inventions will be more clearly understood by way of unrestricted example from the following detailed description taken together with the accompanying drawings in which:

FIG. 3 is a perspective illustration of a three directional five pole filter and power splitter which incorporates the preferred embodiment of the present invention.

The inventions will be readily appreciated by reference to the detailed description when considered in conjunction with the accompanying drawings in which like reference numerals designate like parts throughout the figures.

THE DESCRIPTION OF THE PREFERRED EMBODIMENT

Figure 1:
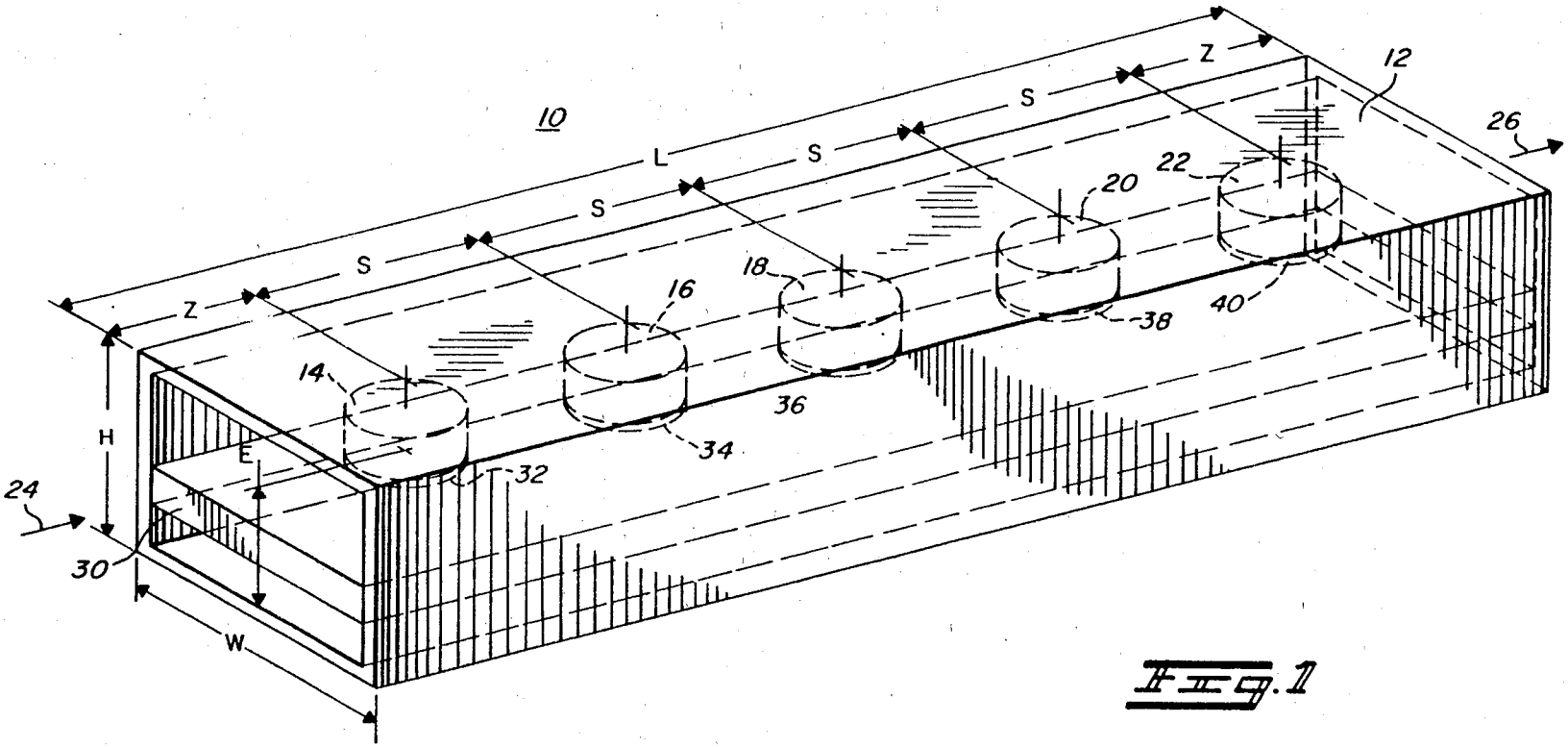
FIG. 1 is a perspective illustration of a five-pole resonator microwave bandpass filter which incorporates the preferred embodiment of the present invention.

FIG. 1 illustrates the preferred embodiment of a five-pole dielectric resonator waveguide bandpass filter, generally designated 10, which incorporates the present invention.

In the preferred embodiment, the transmission medium 12 for the electromagnetic field to be filtered is a waveguide 12 of rectangular cross section operating in the evanescent mode (i.e., below cut off). In accordance with known methodology, the height H and width W of the waveguide are chosen such that the waveguide will cut off all frequencies below a certain level, yet allow higher frequencies to propagate through the waveguide 12. The ratio of the width W to the height H is chosen to properly orient the electric and magnetic components of the electromagnetic field. In the preferred embodiment illustrated in FIG. 1, the height H and width W are chosen such that H is smaller than W so that the magnetic field is distributed across the height H while the electric field is distributed across the width W. The height H and width W are also chosen so as not to substantially interfere with the quality factor Q of the dielectric resonators 14–22. To avoid interfering with the resonator quality factor Q, the height H is chosen to be 3–4 times the resonator thickness T and the width W is chosen to be 2–3 times the resonator diameter D.

The length L of the waveguide 12 is determined by the sum of the interresonator spacings S and the proper spacing Z for coupling to the entry 24 and exit ports 26. Electromagnetic energy may be introduced at the entry port 24 of the waveguide filter 10 by an appropriate waveguide transition (not shown) or by microstrip 28 brought in close proximity to the first dielectric resonator 14. Similarly, electromagnetic energy may be extracted from the filter 10 by an appropriate waveguide transition (not shown) or by microstrip (not shown) brought in close proximity to the last dielectric resonator 22 at the exit port 26.

In the preferred embodiment, the rectagular waveguide 12 is provided with a resonator mounting substrate 30 having a low dielectric constant. The mounting substrate 30 is vertically adjustable such that the position E of the dielectric resonators 14–22 can be adjusted with respect to the magnetic field distributed across the waveguide 12 height H. After the proper vertical elevation E has been established, to provide the desired bandwidth of the filter 10, the substrate 30 may be mechanically fastened or bonded in place. The substrate 30 is useful, though not absolutely necessary, for simultaneously adjusting the vertical elevation E of all the dielectric resonators 14–22.

The dielectric resonators 14–22 may be mounted directly upon the substrate 30. However, for ease of vertical adjustment, while the filter 10 design is being refined (as described below), precision pedestals 32–40, having a relatively low dielectric constant are highly recommended. Similarly, pedestals 32–40 having shim thickness can be employed for fine tuning in the mass production of the filter 10.

In the preferred embodiment, the resonator discs 14–22, configured in a horizontal cascade has been chosen for ease of frequency adjusting. The dielectric resonators 14–22, excited by electromagnetic energy will resonate at one frequency, determined by their individual mass. Advantageously, the resonant frequency of each resonator 14–22 and, therefore, the center frequency of the entire filter 10 can be altered by merely simultaneously altering the thickness T of the resonators 14–22. Having the resonators 14–22 commonly mounted upon the substrate 30 greatly facilitates this operation.

The diameter D and thickness T of the dielectric resonators 14–22 are chosen so that they resonate in their fundamental mode at the desired resonant frequency and such that higher order modes are minimized. A diameter D to thickness T ratio (D/T) of 2–3 has proved to be particularly advantageous.

The dielectric resonators 14–22 receive electromagnetic energy from the entry port 24, are excited to resonate at one frequency, and, in turn, radiate energy at the resonant frequency. The energy dies off exponentially with the distance S from each resonator 14. If a second resonator 16–22 is brought close enough to the energy radiated by the first resonator 14, the second resonator 16–22 will be excited to resonate also. The second resonator 16–22, in turn, will re-radiate energy in all directions, coacting to excite the first 14 and third 18 resonators. This interresonator coupling is responsible for altering the response characteristic of a single dielectric resonator 14 to achieve wider and sharper bandwidth characteristic. Accordingly, only a certain range of frequencies will be supported in the waveguide filter. The amount of energy intercepted by the second resonator 16–22 is a function of its distance S from the first resonator 14 and the amount of energy intercepted at its position E along the magnetic field distribution. Accordingly, the bandwidth of the filter can be controlled by judiciously choosing the interresonator spacing S as well as the transverse positioning E of the resonators 14–22 with respect to the electromagnetic field distribution.

Thus, since bandwidth is a function of the vertical E and lateral S positioning of the resonators 14–22; within limits, one variable may be fixed while the other is adjusted to achieve the desired bandwidth.

Accordingly, in this invention, the filter 10 can be tuned to the proper bandwidth by selecting an interresonator spacing S to provide interresonator coupling and then arriving at the desired bandwidth by adjusting the elevation E at which the resonators intercept the magnetic field distribution. This structure and method of achieving the desired bandwidth greatly facilitates what had been heretofore a laborious process of mechanically tuning the interresonator couplings by disturbing the interresonator energy.

Each center frequency requires a different combination of interresonator spacing S and vertical elevation E.

In filter design, it is well known that bandwidth is a function of the product of the interresonator coupling coefficient and the center frequency.

The method is as follows:

Select an appropriate bandwidth (dictated by the conditions of each particular application). Choose a set of discrete frequencies within the frequency spectrum of interest. For each frequency, fabricate a set of dielectric resonators 14–22 of corresponding thickness T. Begin the converging process with a resonator thickness T.

Set the vertical elevation E of the resonators at some point less than the field strength maximum (H/2) to allow an adjustment range whereby the intercepted field strength may be increased. A set of precision machined pedestals 32'40, having a low dielectric constant will prove highly advantageous for adjusting the vertical elevation E.

Knowing the center resonant frequency of the resonator 14–22 being tested, knowing the desired bandwidth, and knowing that bandwidth is the product of center resonant frequency and interresonator coupling, calculate the required interresonator coupling coefficient. Then, the interresonator spacing S may be set by measuring and monitoring the interresonator coupling coefficient while altering the spacing S. This combination of parameters is one combination of center frequency, interresonator spacing S and vertical elevation E that approaches the desired bandwidth. The coupling coefficient can then be altered by moving toward or away from the field strength maxima (H/2) to acheive the desired bandwidth. Accordingly, this final position (S, E) establishes the filter design parameters for acheiving the desired bandwidth at one frequency.

The following parameters were found using the method of the instant invention in the preferred embodiment of FIG. 1:

| Parameter | Value |
|---|---|
| Waveguide: | |
| Height (H) | 0.55 inches |
| Width (W) | 0.75 inches |
| Length (L) | 4.75 inches |
| Dielectric Constant | 1 |
| Dielectric Resonator: | |
| Diameter (D) | 0.335 inches |
| Thickness (T) | 0.104–0.146 inches |
| Dielectric Constant | 37 |
| Pedestal: | |
| Diameter (D) | 0.335 inches |
| Thickness | 0.106 inches |
| Dielectric Constant | 1 |
| Frequency Spectrum: | 6.4–7.2 GHz |
| Bandwidth: | 70 MHz |
| Interresonator Spacing (S): | 0.8014 inches |
| Dielectric Elevation (E) | 0.106 inches |

Thus, there has been provided a simple dielectric reasonator filter structure that may be easily set to the desired resonant frequency and a method for simply arriving at the desired bandwidth.

Further, there has been provided a single structure that requires little or no tuning of the bandwidth, such that the structure need only be set to the proper resonant frequency and there has been provided a method for designing such a structure.

It will be appreciated by those skilled in the art that various transmission means may be used in lieu of the rectangular waveguide 12 including, but not limited to, round waveguide, microstrip 28 and free space. It will further be appreciated that the dielectric resonators 14–22 need not be discs nor in a horizontally cascaded orientation.

Figure 2:
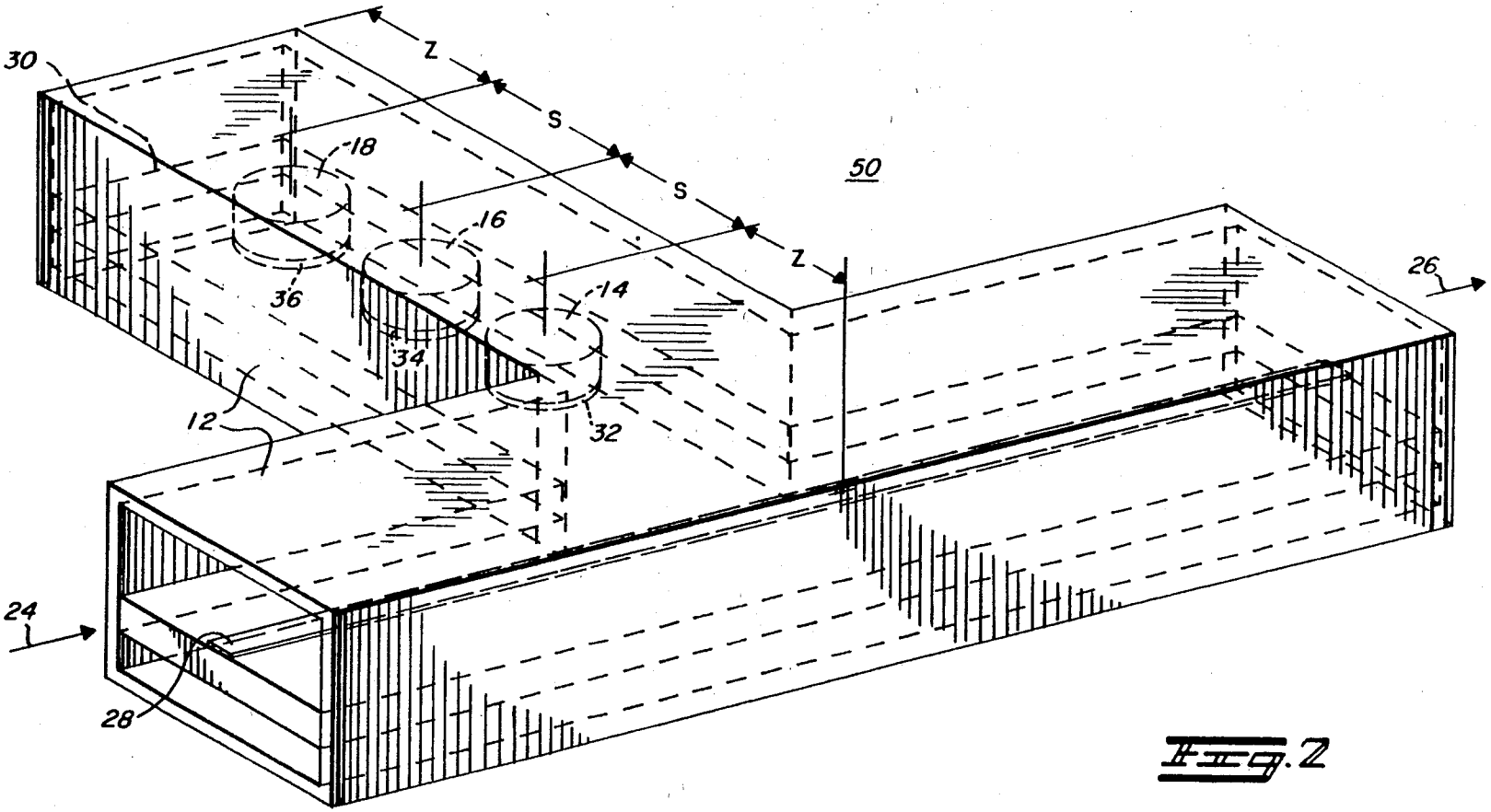
FIG. 2 is a perspective illustration of a three-pole dielectric resonator microwave band elimination filter which incorporates the preferred embodiment of the present invention.
Figure 7:
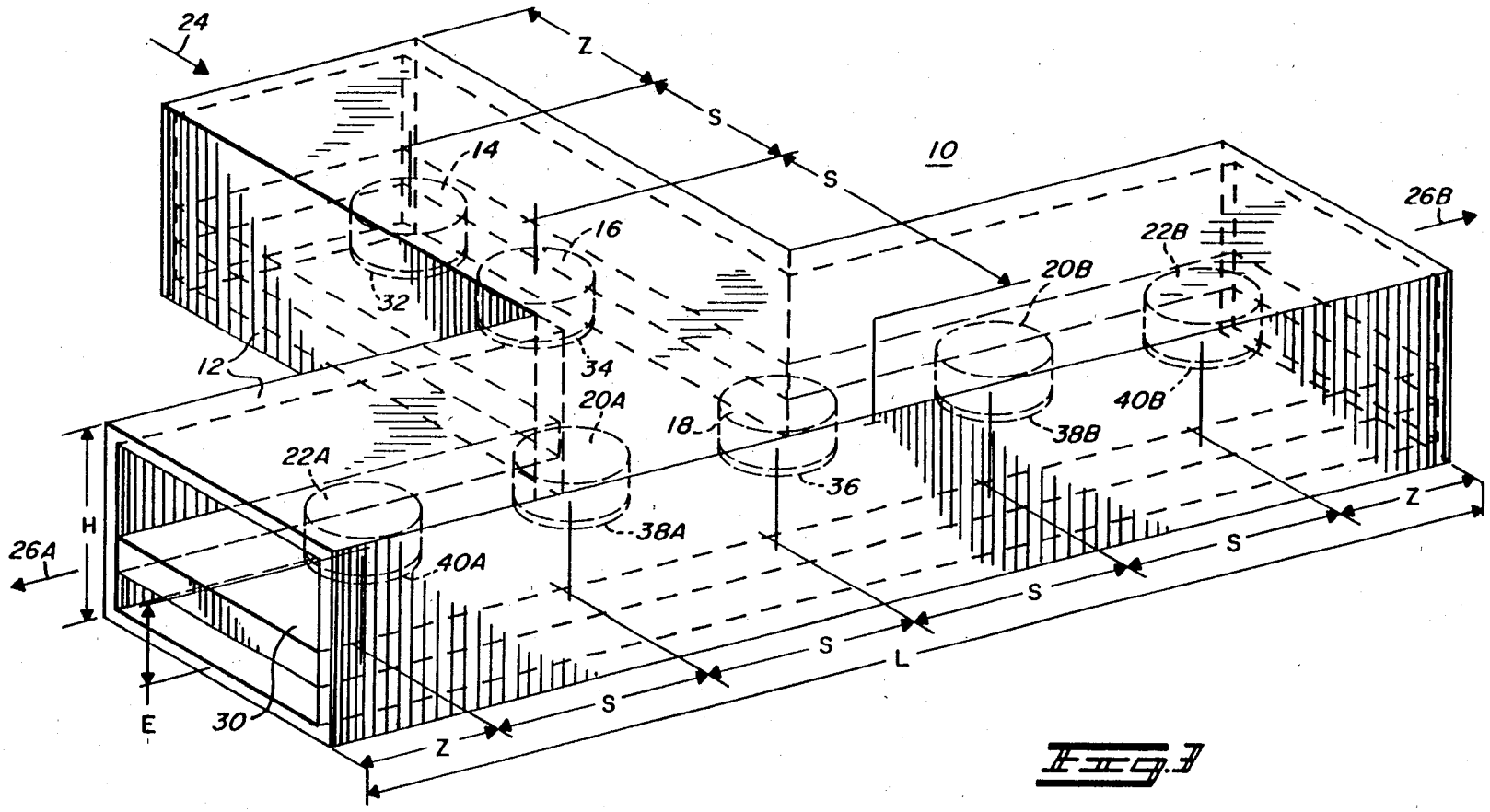

It will further be appreciated that this technique can be applied to a number of filtering situations, for example, as illustrated in FIG. 2, there is illustrated a three-pole dielectric resonator band elimination filter, generally designated 50, whose bandwidth can be controlled as described above.

FIG. 3 illustrates a three directional five-pole filter **14–22*a* and 14–22*b* and power splitter 18, 20*a* and 20*b* that can utilize the present invention while sacrificing a minor degree of precision due to the reduced power splitting couplings (18–20*a* and 18–20*b***).

The foregoing description of the various embodiments are illustrative of the broad inventive concept comprehended by the invention and has been given for clarity of understanding by way of unrestricted example. However, it is not intended to cover all changes and modifications which do not constitute departures from the spirit and scope of the invention.

We claim:

1. A method for mounting and locating dielectric resonators in a filter comprising the sequential steps of:

spacing dielectric resonators to provide interresonator coupling at the frequency of interest, then, positioning the elevation of all of the resonators with respect to an electromagnetic field distributed about the resonator to achieve a desired bandwidth, whereby the longitudinal spacing between dielectric resonators is spaced to provide interresonator coupling over the frequency spectrum of interest, and the desired bandwidth about the center frequency is obtained by altering the elevational position at which the resonators intercept the electromagnetic field.

2. A method as claimed in claim 1 wherein the dielectric resonator filter further comprises:

a bandpass filter.

3. A method as claimed in claim 2 wherein the dielectric resonator filter further comprises:

a waveguide filter.

4. A method as claimed in claim 2 wherein the dielectric resonator filter comprises:

a microstrip filter.

5. A method as claimed in claim 2 wherein the dielectric resonator filter further cpmprises:

a microwave filter.

6. A method as claimed in claim 1 wherein the dielectric resonator filter further comprises:

a band elimination filter.

7. A method as claimed in claim 6 wherein the dielectric resonator filter further comprises:

a waveguide filter.

8. A method as claimed in claim 6 wherein the dielectric resonator filter comprises:

a microstrip filter.

9. A method as claimed in claim 6 wherein the dielectric resonator filter further comprises:

a microwave filter.

10. A method as claimed in claim 1 wherein iterations are at least partially performed by statistical modelling.

11. A method as claimed in claim 1 wherein iterations are at least partially performed by computer simulation.

12. A method as claimed in claim 1 wherein the electromagnetic field is supported in a transmission medium.

13. A method as claimed in claim 12 wherein the transmission medium is a waveguide.

14. A method as claimed in claim 12 wherein the transmission medium is a microstrip.

15. A method as claimed in claim 12 wherein the transmission medium is free space.

16. A method as claimed in claim 1 wherein the elevational positioning is performed with a substrate.

17. A method as claimed in claim 1 wherein the elevational positioning is performed with pedestals.

18. A method as claim in claim 17 wherein the pedestals are of a low dielectric constant with respect to the dielectric resonators.

* * * * *

UNITED STATES PATENT AND TRADEMARK OFFICE

CERTIFICATE OF CORRECTION

PATENT NO. : 4,593,460

DATED : JUNE 10, 1986

INVENTOR(S) : GANNON ET AL.

It is certified that error appears in the above-identified patent and that said Letters Patent is hereby corrected as shown below:

Claim 5, line 55, delete the word "cpmprises" and insert thereat --comprises--.

Signed and Sealed this

*Twenty-sixth* Day of *August 1986*

[SEAL]

*Attest:*

DONALD J. QUIGG

*Attesting Officer*

*Commissioner of Patents and Trademarks*